US008870669B1

(12) United States Patent
Griffin et al.

(10) Patent No.: US 8,870,669 B1
(45) Date of Patent: Oct. 28, 2014

(54) SMOOTH CUE GUIDE

(71) Applicants: Gary L. Griffin, Anaheim, CA (US); Kim Kempf, Westminster, CA (US)

(72) Inventors: Gary L. Griffin, Anaheim, CA (US); Kim Kempf, Westminster, CA (US)

(73) Assignee: Gary L. Griffin, Anaheim, CA (US)

( * ) Notice: Subject to any disclaimer, the term of this patent is extended or adjusted under 35 U.S.C. 154(b) by 63 days.

(21) Appl. No.: 13/694,439

(22) Filed: Dec. 3, 2012

Related U.S. Application Data

(60) Provisional application No. 61/630,466, filed on Dec. 13, 2011.

(51) Int. Cl.
*A63D 15/10* (2006.01)

(52) U.S. Cl.
CPC ..... *A63D 15/105* (2013.01)
USPC ..... 473/43; 473/42

(58) Field of Classification Search
CPC ..... A63D 15/00; A63D 15/105; A63D 15/10; A63D 15/0006
USPC ..... 473/42, 43; D21/782–783
See application file for complete search history.

(56) References Cited

U.S. PATENT DOCUMENTS

| | | | | | |
|---|---|---|---|---|---|
| 453,797 | A * | 6/1891 | Wickliffe | 473/42 |
| 855,684 | A * | 6/1907 | Williamson | 473/42 |
| 898,345 | A * | 9/1908 | Farnham | 473/42 |
| 968,187 | A * | 8/1910 | McIntire | 473/42 |
| 2,931,649 | A * | 4/1960 | Furda | 473/42 |
| 5,238,457 | A * | 8/1993 | Triplett | 473/42 |
| D354,106 | S * | 1/1995 | Thompson | D21/726 |
| D391,614 | S * | 3/1998 | Meredith | D21/726 |
| 5,853,333 | A * | 12/1998 | Patterson | 473/42 |
| 6,267,685 | B1 * | 7/2001 | Cannon | 473/42 |
| 2011/0201436 | A1 * | 8/2011 | Robinson et al. | 473/42 |

FOREIGN PATENT DOCUMENTS

| | | | | |
|---|---|---|---|---|
| DE | 19512851 C1 * | 3/1996 | | A63D 15/10 |
| GB | 2148134 A * | 5/1985 | | A63D 15/10 |
| GB | 2161393 A * | 1/1986 | | A63D 15/10 |
| GB | 2196867 A * | 5/1988 | | A63D 15/10 |

* cited by examiner

*Primary Examiner* — Mitra Aryanpour

(57) ABSTRACT

A hand held guide for use with a cue stick for aiding a user to establish a straight and smooth stroke. The user holds the elongated cylindrical support handle firmly, the cue stick glides through the transparent tube, the base plate swivels so that the player can line up his/her shot in order to achieve a perfect shot each time.

4 Claims, 6 Drawing Sheets

SMOOTH CUE GUIDE

BACKGROUND OF THE INVENTION

1. Field of the Invention

The present invention generally relates to a Smooth Cue Guide (SMOOO "Q" Guide) for use with a cue stick which enables the cue stick to be more accurately aimed and controlled when hitting the cue ball. The guide includes a clear or transparent guide tube which aids in an easy gliding engagement with the cue stick. While the user is holding the cylindrical handle, the base plate can be freely pivoted in order to properly align the cue stick with the cue ball in order to achieve a perfect shot each time.

2. Description of the Prior Art

Various training devices have been provided to enable a cue stick to be guided when striking a cue ball. Such devices are commonly used when the cue ball is in a position on a table that requires the cue stick to be extended substantially across the table. These training devices, usually are referred to as "bridges", and only provide supporting engagement with the undersurface of the cue stick and do not provide any substantial guiding function. Other devices are known which is hand held and facilitate sliding movement of the cue stick in relation to facilitate hand of the user but again do not provide any substantial guiding function.

SUMMARY OF THE INVENTION

An object of the present invention is to provide a Smooth Cue Guide (SMOOO "Q" Guide) incorporating a hand held, longitudinally elongated, clear or transparent tube or sleeve and a base plate pivotally attached to a cylindrical handle. When the SMOOO "Q" Guide is in use it facilitates the longitudinal movement of the cue stick by enabling the SMOOO "Q" Guide to smoothly pivot the elongated guide tube in order maintain, accurately control and properly align the cue stick to strike the cue ball.

Another object of the invention is to provide a Smooth Cue Guide (SMOOO) "Q" Guide) in accordance with the preceding object in which the guide allows the user to increase the accuracy of his/her stroke while holding the handle and gliding the cue stick through the elongated guide tube.

A further object of the invention is to provide a guide in accordance with the preceding objects having a laterally extending, adjustable length support member rigid with respect to the sleeve and perpendicular thereto for supporting engagement with the surface of the pool table to further control the aim and provide a steady support for the guide and cue stick guided thereby.

Still another important object of the present invention is to provide a guide in accordance with the preceding objects which is relatively simple in construction, light weight, easy to use, effective to pivotally support a pool cue stick and maintain an accurate aim and path of movement for the cue stick.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
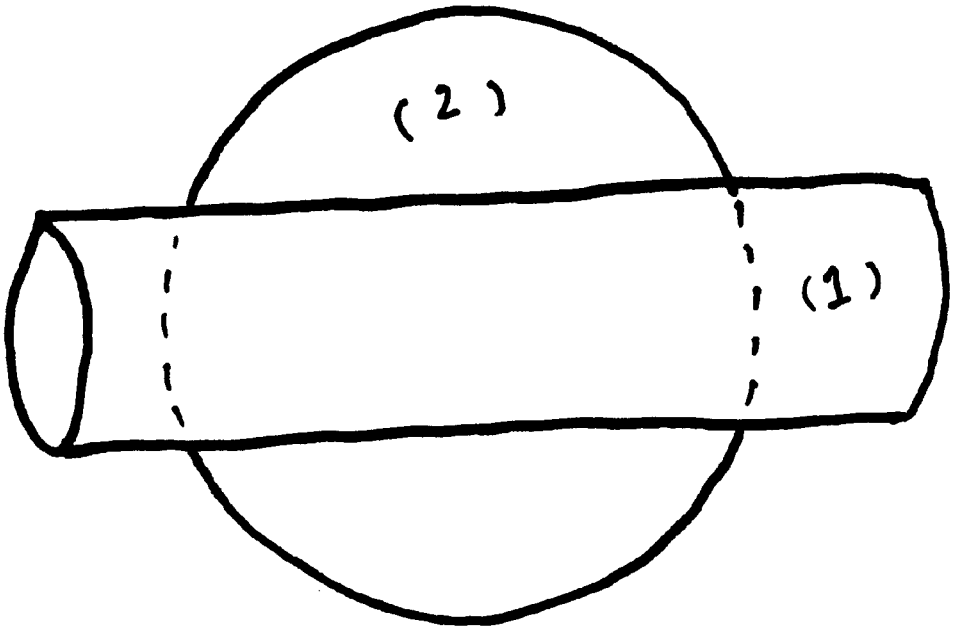
FIG. 1 is a top view of Smoo "Q" guide showing the elongated guide tube and the swivel base plate.
Figure 2:
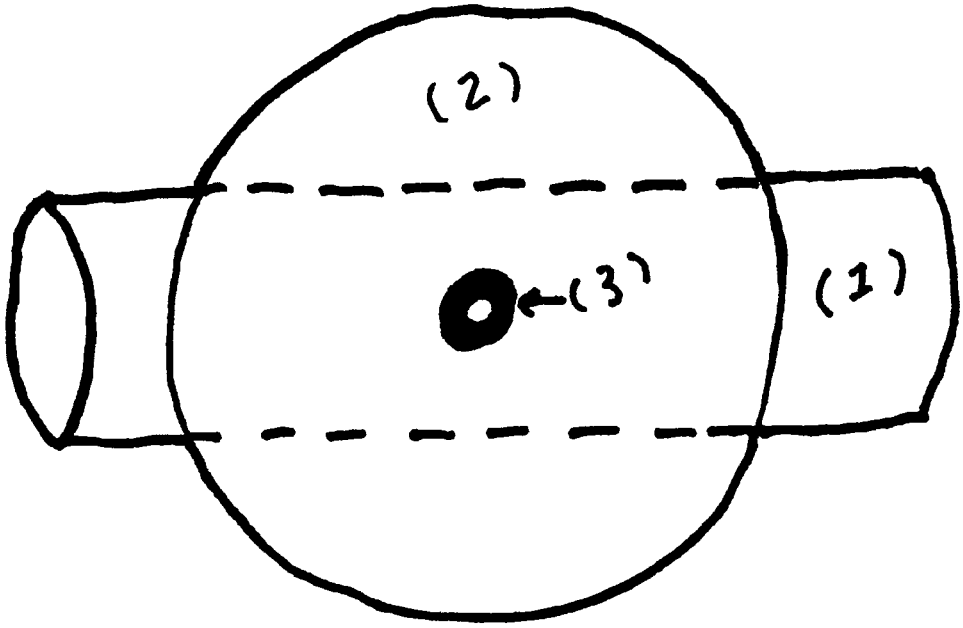
FIG. 2 is a bottom view of Smoo "Q" guide showing the elongated guide tube, the swivel base plate and the socket for receiving a ball.
Figure 3:
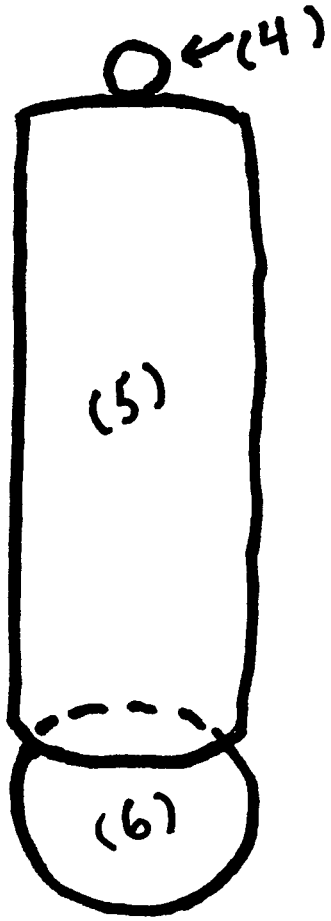
FIG. 3 is a view of the elongated cylindrical handle having a ball attached to an upper end and a decorative "FOB" attached to a lower end.
Figure 4:
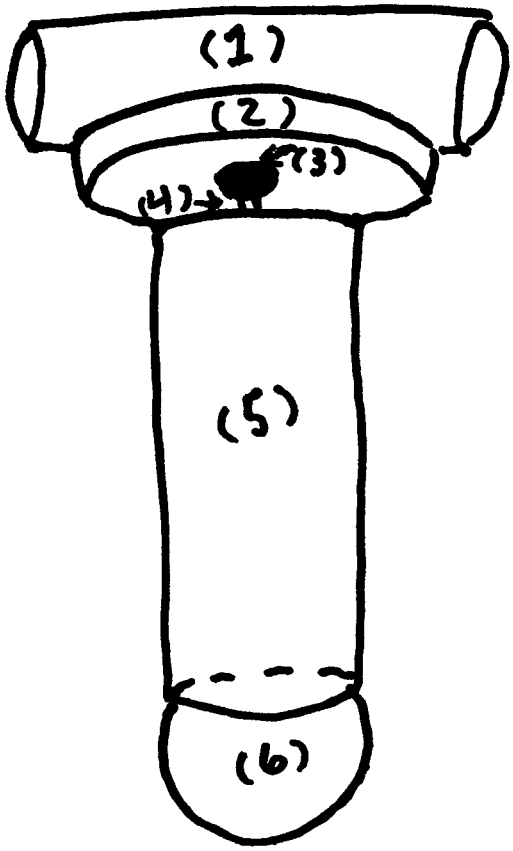
FIG. 4 is a front view of Smoo "Q" guide showing the elongated guide tube, the base plate, the ball and socket, the elongated cylindrical handle and the FOB.
Figure 5:
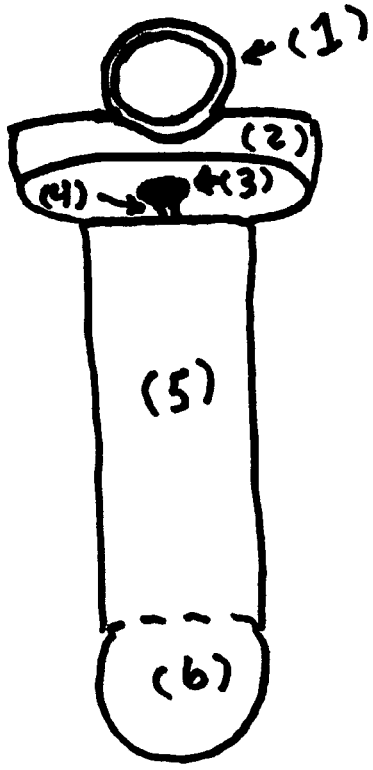
FIG. 5 is a side view of Smoo "Q" guide showing the elongated guide tube, the base plate, the ball and socket, the elongated cylindrical handle and the FOB.
Figure 6:
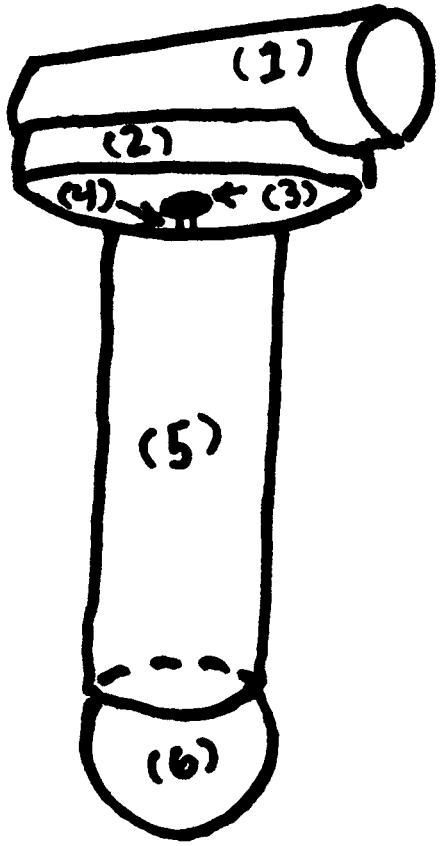
FIG. 6 is a perspective view of Smoo "Q" guide showing the elongated guide tube, the base plate, the ball and socket, the elongated cylindrical handle and the FOB.

The Smooth Cue Guide (SMOOO "Q" Guide) of the present invention is illustrated in FIG. 6 for guiding a cue stick toward a cue ball for causing the cue ball to move along a pool table surface toward a target area, ball, or the like, in which it is necessary to properly position the cue stick so that its tip will be properly positioned with respect to the cue ball and the tapered shaft of the cue stick will be properly aimed and controlled during its movement toward the cue ball in a manner which is well known in playing pool or other similar games.

The device may be constructed of plastic material, metal, wood or any other suitable equivalent materials, can be formed in any color or patter, and most preferably from a clear or transparent material, thus rendering the device relatively inexpensive to manufacture and easily used by various pool players regardless of the size of cue stick which is used within the limits of the swinging movement of the elongated guide tube.

In a preferred embodiment the Smooth Cue Guide (SMOOO "Q" Guide) is formed of an elongated, cylindrical handle (5) having sufficient length to allow a user to comfortably hold the guide by at least one hand. The handle (5) may have other shapes, but cylindrical is preferred since it can be more conveniently held by a user. The handle includes an upper and lower end, a personalized accessory "FOB" (6) which may include indicia, is securely attached to the lower end of the handle using any well-known connection including male female snap connection or glue. A ball (of a ball and socket joint) (4) is attached to the upper end of the handle. The ball (4) includes a threaded shaft which is received in a threaded opening which is bored in the center of the elongated cylindrical handle. A base plate having an upper surface and a lower surface and a central opening for receiving a cup or socket (of a ball and socket joint) (3) bored therein, thus pivotally attaching the base plate (3) to the elongated handle (5). Alternatively, the threaded shaft of the ball (4) can be attached to the base plate and the cup or socket can be formed in the cylindrical handle. The internal diameter of the cup or socket is less than the external diameter of the ball. The base plate is preferably circular in shape, but the base plate can be in any other geometric shape. An elongated guide tube is securely attached to the upper surface of the base plate using any well-known means including glue. The elongated guide tube includes a diameter sufficient to allow a cue stick to glide therethrough.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed:

1. A hand held guide for a billiard cue stick comprising:

an elongated cylindrical support handle having a length for allowing a user to grasp and hold the support handle; said support handle including a first end and a second end, wherein the first end includes a central opening for receiving a first portion of a ball and socket joint and the second end including means for attaching an accessory thereto;

a base plate having a top surface and a bottom surface, wherein the base plate includes a central bore for receiving a second portion of the ball and socket joint; wherein the ball and socket joint pivotally attach the base plate to the support handle; and an elongated hollow guide tube securely attached to the upper surface of the base plate;

wherein a user grasps the support handle while glidingly positioning a cue stick through the guide tube, the base plate is then freely pivoted to the desired position in order to properly align the cue stick with a cue ball to achieve a perfect shot each time.

2. The hand held guide as defined in claim 1, wherein said guide is selected from a group consisting of metal, wood and plastic.

3. The hand held guide as defined in claim 1, wherein the base plate is circular in shape.

4. The hand held guide as defined in claim 1, wherein the cue guide is formed of a transparent material.

* * * * *